United States Patent [19]

Lafaye

[11] 4,214,222

[45] Jul. 22, 1980

[54] IMPROVED CLAMPING MEMBERS IN A HORIZONTAL MAGNETIC CORE POWER TRANSFORMER

[75] Inventor: Jean P. Lafaye, Oullins, France

[73] Assignee: Jeumont-Schneider, Puteaux, France

[21] Appl. No.: 18,096

[22] Filed: Mar. 6, 1979

[30] Foreign Application Priority Data

Mar. 9, 1978 [FR] France ..... 78 06738

[51] Int. Cl.[2] ..... H01F 27/26

[52] U.S. Cl. ..... 336/84 M; 336/60; 336/92; 336/210; 336/212

[58] Field of Search ..... 336/84 R, 84 M, 60, 336/90, 92, 212, 210, 234

[56] References Cited

U.S. PATENT DOCUMENTS

| | | | |
|---|---|---|---|
| 3,538,472 | 11/1970 | Bell et al. | 336/84 M |
| 3,577,109 | 5/1971 | Foster | 336/84 M |
| 3,614,695 | 10/1971 | Palmer | 336/210 |

FOREIGN PATENT DOCUMENTS

| | | | |
|---|---|---|---|
| 1912679 | 11/1969 | Fed. Rep. of Germany | 336/60 |
| 983481 | 2/1965 | United Kingdom | 336/212 |

*Primary Examiner*—Thomas J. Kozma

*Attorney, Agent, or Firm*—Schwartz, Jeffery, Schwaab, Mack, Blumenthal & Koch

[57] ABSTRACT

Improved end clamping members are used in transformers having a horizontal magnetic circuit which is preferably of rectangular cross-section.

Each end clamping member is embodied by juxtaposed longitudinal beams—side beams (4) comprising magnetic laminations on edge over substantially their whole thickness, and intermediate beams (5) comprising magnetic laminations on edge over only some of their thickness, the end clamping member being embodied for the rest by a longitudinal flat iron member (15), and each group or set of magnetic laminations has at its center the longitudinally extending wedge-shaped member and on each side another longitudinally extending flat iron member of the same width.

The invention is of use more particularly for high-power shell type transformers in a form-fit tank.

2 Claims, 5 Drawing Figures

Fig.1
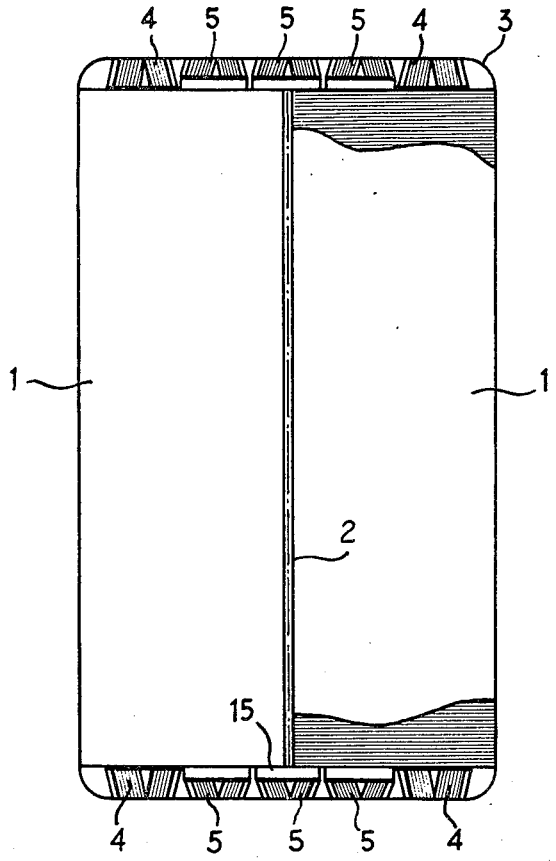
Fig.2
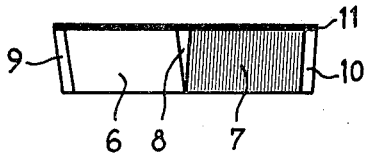
Fig.3
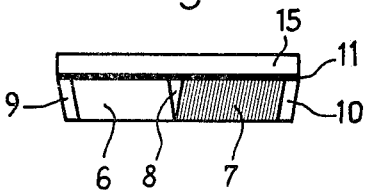
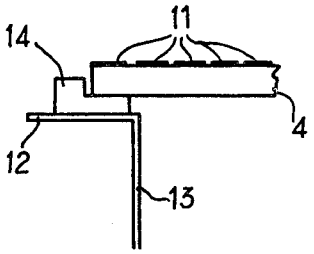
Fig.4
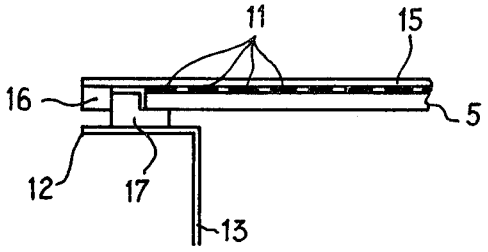
Fig.5

IMPROVED CLAMPING MEMBERS IN A HORIZONTAL MAGNETIC CORE POWER TRANSFORMER

BACKGROUND OF THE INVENTION

The invention relates to an improvement in or relating to the end clamping members of a magnetic core of a power transformer having a horizontal and preferably cross-section magnetic circuit, the ends of the clamping members bearing on the wall of the transformer tank.

The invention relates more particularly to a shell type transformer in a form-fit tank. The magnetic circuit of such a transformer is horizontal and the tank is in two parts—a bottom part or base having a flange serving as end member for the yokes of the magnetic circuit, and a top part or dome which serves to clamp the yokes. The magnetic core, which is usually vertically divided into two equal parts by a cooling channel, is borne by a T-beam bearing at its ends on the flanges of the base, the vertical "stroke" of the T being positioned at the bottom of the channel. Magnetic shunts are welded below the horizontal web or "dash" of the T-beam, the shunts usually being welded on edge and serving to channel leakage flux. The magnetic shunts welded along each edge of the said web—i.e., the magnetic shunts near the edges of the magnetic core—are the ones which are the most heavily saturated by the leakage flux and therefore the ones determining how high the magnetic shunts must be. As a rule, the end clamping member for the top of the magnetic core is constructed symmetrically in respect of the end clamping member for the bottom of the magnetic core as just described except that the T-beam has no "stroke". The disadvantages of such a system are that some of the magnetic shunts are needlessly high, while the "stroke" of the T-beam either impedes the flow of oil in the central channel of the core or requires the presence of such a channel in cases where there is no other reason for providing a channel.

SUMMARY OF THE INVENTION

The improvement according to this invention obviates all these disadvantages by making it possible to obviate the T-beam and replace it by a number of parallel beams, so that the central cooling channel can be obviated or reduced in size, the improvement also making it possible to differentiate the functions of each beam so that better adaptation of the height of the magnetic shunts is possible. Consequently, the width of the magnetic core can be reduced because of the reduction in size of the central cooling channel, and the overall thickness of the end clamping members can be reduced—i.e., the end result is that the size of the transformer can be reduced.

The improvement according to the invention is distinguished in that each end clamping member is embodied by juxtaposed longitudinal beams comprising in each case: two side beams each consisting of a set of magnetic laminations of the same width and soldered at their edge to a number of cross-plates; and a number of beams intermediate the said two side beams and devised like the latter but with narrower magnetic laminations and with a longitudinal extending flat iron member welded at its edges along the ends of the cross-plates, the two side beams and the intermediate beams being of the same height and being so disposed that their magnetic laminations are positioned on edge, each set of magnetic laminations having at its centre a longitudinally extending wedge-shaped member and being strengthened on each side by another longitudinally extending flat iron member of the same width.

BRIEF DESCRIPTION OF THE DRAWINGS

The invention will be more clearly understood with reference to an embodiment and to the accompanying drawings wherein:

FIG. 1 is a vertical section through a magnetic core of a shell type transformer having a horizontal magnetic circuit and through its end clamping members;

FIG. 2 is a section through a side beam of the bottom end clamping member;

FIG. 3 is a section through an intermediate beam of the bottom end clamping member;

FIG. 4 is a sketch showing how the beam of FIG. 2 bears on the flange of the tank, and FIG. 5 is a sketch showing how the beam of FIG. 3 is anchored to the tank flange.

DETAILED DESCRIPTION OF A PREFERRED EMBODIMENT

Referring to FIG. 1, a magnetic core comprising a central cooling channel or duct 2 is shown with its top and bottom end clamping members inside an outline 3 representing the inside surface of the insulation of the windings around the core 1.

The bottom and top end clamping members are identical to one another and each comprise two side beams 4 and three beams 5 intermediate the beams 4. The beams 4, 5 are made of magnetic laminations of from 0.3 to 0.4 mm thick—i.e., the same thickness as used in the magnetic circuit of the transformer.

Referring now to FIG. 2, the beam 4 comprises two groups or sets 6, 7 of such laminations which are e.g. 4 cm wide and of substantially the same length as the core laminations. The identical groups or sets 6, 7 are separated by a longitudinal wedge-shaped spacer 8 embodied by a hard board strip measuring 4 mm in its thickest part; the groups 6, 7 are laterally strengthened by two flat iron members 9, 10 which are of the same width as the magnetic laminations and e.g. 5 mm thick. After appropriate assembly and clamping, the whole is welded by its edge along the whole perimeter of a number of rectangular cross-plates 11 which are e.g. 2 mm thick and which are shown in heavy black line in FIGS. 2 and 4. After welding the laminations forming the groups 6, 7 tend to open up like a fan, but the spacer 8 produces a slight inclination of the latter laminations in the manner visible in FIG. 2, with the result that because of shear stresses the laminations are clamped together on the side remote from the plates 11.

The beams 4 of the bottom end clamping member bear at their ends, and by way of a member 14, on flange 12 of the bottom part of transformer tank 13.

The beam 4 shown in FIGS. 2 and 4 consists mainly of magnetic laminations so as to channel the leakage flux, which is greater at the core corners than anywhere else.

The beam 5 is of similar construction so far as the elements 6–11 are concerned, which are shown again, with the same references, in FIGS. 3 and 5. However, the beam 5 differs as follows: The width of the magnetic lamination is less, e.g. 3 cm instead of 4 cm. The resulting loss of 1 centimeter in beam thickness is made up by placing adjacent the plates 11 a longitudinally extending flat iron member 15 welded by its edges along the ends of the cross-plates 11. The member 15 is 1 cm thick and has the same width as the remainder of the beam 5 but projects something like 10 cm at each end beyond the lamination groups of the beam 5, since a metal member 16 is welded to each of the latter ends and abuts a metal member 17 which is similar to the member 14 and welded to the tank flange 12, to form means for securing the beam 5 to the tank wall. This facility can be adjusted, e.g. by means of wedges introduced between the members 16 and 17, to prestress the beam 5 if required—i.e., to tension the beam 5 as a means of increasing the clamping of the bottom part of the windings in the tank base.

The end clamping member of the top of the core is identical to the end clamping member just described for the bottom of the core.

The intermediate beams 5 have in fact four functions—to support the magnetic core, help to clamp the same, reduce flux leakage losses and help to clamp the windings.

The side beams 4 do not help to clamp the windings but are more active than the beams 5 in reducing leakage flux losses.

Improving the distribution in this way of the functions performed by the respective beams which make up the end clamping members makes it possible to reduce the height thereof—i.e., to reduce the size of the transformer. Also, since there is no "stroke" of a T-member in the cooling channel 2, the dimension thereof can be reduced, thus further helping to reduce transformer size.

Preferably, all the welds referred to are of non-magnetic metal.

What is claimed is:

1. An improved power transformer having a horizontal magnetic core with a rectangular cross-section, end clamping members on opposite sides of said core with ends bearing on walls of a transformer tank, each clamping member having a number of longitudinal beams (5) intermediate and juxtaposed with two longitudinal side beams (4), said two side beams (4) each comprising of a set of magnetic laminations (6, 7) of the same width and welded at their edge to a number of cross-plates (11); said intermediate beams (5) being between said two side beams (4) and each comprising a set of laminations (6,7) of the same width and welded at their edge to a number of cross plates (11), the laminations of the intermediate beams being narrower than the laminations of the said side beams and each having a longitudinal extending flat iron member (15) welded at its edges along the ends of the cross-plates (11), the two side beams (4) and the intermediate beams (5) being of the same height and being so disposed that their magnetic laminations are positioned on edge, each set of magnetic laminations (6, 7) having at its centre a longitudinally extending wedge-shaped member (8) and being strengthened on each side by another longitudinally extending flat iron member (9, 10) of the same width.

2. An improvement according to claim 1, characterised in that the intermediate beams (5) have their flat iron members (15) extended at both its ends, each such end having provision (16, 17) for securing to the wall (12) of the tank (13).

* * * * *

UNITED STATES PATENT AND TRADEMARK OFFICE

CERTIFICATE OF CORRECTION

PATENT NO. : 4,214,222

DATED : July 22, 1980

INVENTOR(S) : Jean P. LAFAYE

It is certified that error appears in the above—identified patent and that said Letters Patent is hereby corrected as shown below:

In column 1, line 10, before the word "cross-section" insert -- rectangular --.

Signed and Sealed this

*Third* Day of *February 1981*

[SEAL]

*Attest:*

RENE D. TEGTMEYER

*Attesting Officer*

*Acting Commissioner of Patents and Trademarks*